US005782414A

United States Patent [19]

Nathenson

[11] Patent Number: 5,782,414

[45] Date of Patent: Jul. 21, 1998

[54] CONTOURED SUPERSONIC NOZZLE

[76] Inventor: Richard D. Nathenson, 5301 Fair Oaks St., Pittsburgh, Pa. 15217

[21] Appl. No.: 669,212

[22] Filed: Jun. 24, 1996

Related U.S. Application Data

[60] Provisional application No. 60/000,511 Jun. 26, 1995.

[51] Int. Cl.[6] ..... B05B 1/00

[52] U.S. Cl. ..... 239/589; 239/601; 239/532

[58] Field of Search ..... 239/532, 589, 239/601, 590, 592, 594, DIG. 7

[56] References Cited

U.S. PATENT DOCUMENTS

| | | | |
|---|---|---|---|
| 2,175,160 | 10/1939 | Zobel et al. | 239/589 |
| 2,583,726 | 1/1952 | Chalom | 239/601 |
| 3,550,864 | 12/1970 | East | 239/601 |
| 3,620,457 | 11/1971 | Pearson | 239/589 |
| 3,921,915 | 11/1975 | Glenn et al. | 239/589 |
| 4,300,723 | 11/1981 | Prasthofer | 239/499 |
| 4,448,354 | 5/1984 | Reznick et al. | 239/DIG. 7 |
| 4,455,166 | 6/1984 | Brancaz et al. | 75/60 |
| 4,813,611 | 3/1989 | Fontana | 239/589 |
| 5,170,943 | 12/1992 | Artzberger | 239/532 |
| 5,170,946 | 12/1992 | Rankin | 239/590 |
| 5,212,891 | 5/1993 | Schuermann et al. | 37/62 |

OTHER PUBLICATIONS

Ascher H. Shapiro, "The Dynamics and Thermodynamics of Compressible Fluid Flow", Robert E. Krieger Publishing Company, vol. I and II, 1983, pp. 139, 141, 143 and 676–681, 694–695, 700–701.

A. E. Puckett, "Supersonic Nozzle Design", Journal of Applied Mechanics, vol. 13, No. 4, Dec. 1946, pp. A-265–A-270.

K. Foelsch, "The Analytical Design of an Axially Symmetric Laval Nozzle for a Parallel and Unifrom Jet", Journal of the Aeronautical Sciences, Mar. 1949, pp. 161–166 and 185.

G.V.R. Rao, "Approximation of Optimum Thrust Nozzle Contour", ARS Journal, vol. 30, No. 6, Jun. 1960, p. 561.

Sinyarev and Doborovolskii, "Zhidkostne LRaketne Drigateli", Moscow, 1957 (in Russian), pp. 366–367 and 370–371 and one page of translation.

R.E. Wilson, "Turbulent Boundary Layer Growth with Favorable Static Pressure Gradient at Supersonic Speeds" Proceedings of the Second Midwestern Conference on Fluid Mechanics, The Ohio State University, 1952, pp. 277–289.

*Primary Examiner*—J. Casimer Jacyna

*Attorney, Agent, or Firm*—Webb Ziesenheim Bruening Logsdon Orkin & Hanson, P.C.

[57] ABSTRACT

A nozzle for accelerating compressed gas, preferably air, to supersonic speeds comprising converging, expansion, and straightening portions defined by a simple combination of arcs and a line segment for the general purpose of producing a supersonic jet to excavate or dislodge soil or other like material.

22 Claims, 3 Drawing Sheets

CONTOURED SUPERSONIC NOZZLE

CROSS REFERENCE TO RELATED APPLICATION

This application claims the benefit of copending Provisional Application Ser. No. 60/000,511, filed on Jun. 26, 1995.

BACKGROUND OF THE INVENTION

1. Field of the Invention

The present invention relates to a nozzle used to accelerate a gas to supersonic speeds and, in particular, to a supersonic gas jet nozzle for excavating or dislodging soil or other like material.

2. Background Art

For many years it has been well known that compressed gas, generally air, released in close proximity to and directed toward the earth can result in loosening of a number of types of soil. A wand or tool, consisting of a valve, length of pipe or tubing, and ending in a reduced sized nipple, supplied with air from a standard portable compressor, is commonly used for the purposes of dislodging soil safely from around underground utilities such as gas, water, or sewer pipes and electric, telephone, television, or other cables. The compressed air does not pose a hazard of damaging the buried utility as does a pick, digging bar, spade, bucket, or blade.

With the current emphasis on public and private remediation of hazardous waste sites, the ability to unearth safely other types of buried objects is becoming increasingly important. From the industrial or nuclear energy sectors, such objects include glass bottles, cardboard or wood boxes, metal or fiber drums, or metal cylinders of chemical or radioactive waste. From the military sector, objects include all types of unexploded ordnance or chemical munitions.

Recently, a number of tools have been marketed that claim to produce a superior air stream for improved digging purposes by employing a means to make the air exit the tool at a supersonic speed. Little attention has been paid to the proper engineering design of these nozzles for the purpose to which it is intended. Even a pipe nipple discharging air at a pressure of 60 to 100 psig will have some local regions of the flow field that are supersonic.

For example, U.S. Pat. No. 4,813,611 to Fontana discloses a compressed air nozzle for use with a hand tool as described above. The cited dimensional relationships of Fontana's nozzle appear to be empirically based and do not correspond to gas dynamic relations to be described subsequently. As would be expected, his cited performance appears to be degraded as a result. Although U.S. Pat. No. 5,170,943 to Artzberger discloses a similar tool with a handle, valve, electrically insulating barrel, and a nozzle, there is a problem with the supersonic velocity performance claimed. To achieve the air exit velocities cited in the patent, the nozzle, only noted as being a converging then diverging passage, would have to be supplied with compressed air at well over double the 100 psig stated in their trade literature and generally available from a standard, portable air compressor. Similar lack of detail and conflicting performance claims are evident in U.S. Pat. No. 5,212,891 to Schuermann et al.

The correct design procedures and manufacturing methods for a nozzle to produce the flow of a gas at a supersonic speed have been developed to a high degree by the aerospace industry. As will be explained in more detail later, these procedures are generally very complicated and time consuming. While the effort can be justified, for example for the space shuttle main engines, a simpler scheme is needed that is both technically correct and easy to manufacture for gas jet excavation nozzles. The present invention discloses a simple, but correctly contoured supersonic nozzle to produce a uniform jet. To understand fully the present invention and its benefits over and relation to the prior art, it is necessary to review the theory of the flow of a compressible gas through a passage of varying cross section.

As discussed for example by Ascher H. Shapiro, in *The Dynamics and Thermodynamics of Compressible Fluid Flow*, Robert E. Krieger Publishing Company, Volumes I and II, 1983, traditional gas dynamics describes the changes in pressure, temperature, density and velocity of a gas as it flows through a passage of varying cross section. For many situations, the equations for an isentropic process may be used. The friction of the gas flow on the wall is small and no heat enters or leaves the gas. Depending on the gas inlet conditions and whether the passage narrows or enlarges, the flow may accelerate or decelerate at sub or supersonic speeds.

In particular, through a converging passage, a subsonic gas flowing at an inlet pressure elevated over that at the exit will increase in speed and reduce in pressure. For a given inlet pressure, the flow will be subsonic to and at the exit as long as the exit pressure is above a critical value. If the exit pressure is at this critical value, the gas flow at the end of the convergent passage reaches sonic velocity. Further reductions in exit pressure will not lead to any additional increases in velocity at the exit with only the convergent passage. For example, for air at 85 psig, the critical pressure ratio is 0.528 and the corresponding exit pressure is approximately 38 psig.

In order to accelerate the gas further, a diverging passage must be added at the end of the converging section. The transition between the converging and diverging portions is the section of minimum area and is generally termed the throat. As the pressure at the exit of the diverging portion is decreased below the critical value at the throat, the gas continues to accelerate to supersonic speeds and drops in pressure. The combination of the converging, throat, and diverging passages makes up a complete supersonic nozzle.

As mentioned above for given inlet and exit pressures, the equations of isentropic gas flow will determine the exit velocity of the gas. As the velocity increases through the nozzle, the temperature and density of the gas decrease. Tables relating the ratios of these parameters may be found in any standard entry level textbook covering one dimensional gas dynamics. The ratio of the velocity of the gas to the local speed of sound is termed the Mach Number. For air flowing from 85 psig to atmosphere, the Mach Number at the jet exit is about 1.9.

A subtle distinction has to be noted between the actual exit pressure of the nozzle and the local pressure into which the nozzle discharges. Deviations of the local pressure from the design exit pressure of the nozzle lead to non-isentropic behavior as the gas at the exit either expands or compresses to match the difference. Extreme differences can even lead to the formation of standing shock waves in or beyond the nozzle which decelerate the flow across them suddenly from supersonic to subsonic. A prime example of this later instance referred to earlier is when compressed air exhausts to atmosphere just from a pipe nipple. Depending on the exact upstream pressure, a pattern of standing shocks and Mach disks form downstream of the nipple exit. The overall flow pattern is not well focused and highly dissipative.

The one dimensional isentropic solution does not completely determine all of the parameters for a nozzle since only the ratios of the areas of the nozzle between sections are specified. The absolute cross sectional dimensions of the nozzle are set by the additional specification of the desired mass flow with larger flows requiring larger physical sizes. For example, for a nozzle flowing 50 standard cubic feet per minute (scfm) from 85 psig to atmosphere, the throat diameter is approximately 0.19 inches and the exit to throat area ratio is about 1.6.

The complete determination of a nozzle's diameters and lengths to achieve specific flow profiles and performance has been traditionally done through the use of the "Method of Characteristics". Initially done graphically and today numerically with a digital computer, this method generally consists of marching and mapping out the flow field along a grid of intersecting characteristic lines along which certain flow parameters are known to be constant. Wall profiles are determined by finding a consistent set of waves that expand and turn the flow as desired from the known conditions at the throat to the desired exit conditions. The local wall contour of the nozzle at the throat determines the exact shape of the sonic profile which is in general the starting point for the calculations. Experiments and high speed digital computer codes that model supersonic flow have been used to analyze and verify the performance of the nozzle designs. Other engineering criteria further define the specific resulting contour such as: maximum thrust with minimum length, maximum thrust with minimum surface area, or uniform exit flow. The general steps in constructing a planar, two dimensional, nozzle by the Method of Characteristics are outlined in advanced texts or papers on supersonic flow, for example, as by A. E. Puckett, "Supersonic Nozzle Design", Journal of Applied Mechanics, Vol. 13., No. 4, December 1946, pp. A-265–A-270. The extension of the method to axially symmetric nozzles is, however, more complicated.

Application of Euler's equation to the axially symmetric, steady, irrotational, isentropic, supersonic flow of a perfect gas without viscosity or thermal conductivity yields a set of two second order, quasi-linear partial differential equations in two variables. The solution of these equations may be thought of as a three dimensional, integral surface expressing the velocity potential as a continuous function of the two independent spatial coordinates, here the axial and radial coordinates of the nozzle. As these equations are hyperbolic in nature, two characteristic curves exist and pass through each solution point on this surface. For this supersonic flow the projections of these curves on the physical coordinate plane are Mach lines where the fluid properties and velocities are continuous, but the derivatives of the velocities may be discontinuous. The existence of the characteristic curves allows the solution of the original non-linear partial order differential equations to be replaced by the task here of solving two pairs of ordinary differential equations of first order. The solution proceeds by the construction of characteristic projection nets on two planes, the physical plane consisting of the independent coordinates and the hodographic plane consisting of the velocity components.

Unlike, however, for the two dimensional nozzle described by Puckett where the constructions are independent, the axially symmetric nozzle requires the more complicated simultaneous solution of the nets in both planes. Given the values of velocity at many points along a non-characteristic curve in the coordinate plane and using the slopes given by the characteristic curves in the physical and hodographic planes, one proceeds to determine in a pyramid fashion the surrounding flow pattern using adjacent points two at a time. Special adaptations of the method allow one to deal with solid or symmetric boundaries of the flow. In Shaprio's Appendix A, he gives a thorough general discussion of the Theory of Characteristics and the application of the method.

The design of an axisymmetric nozzle to produce a uniform supersonic flow is started at the throat where the contour of the sonic surface is assumed to be known. The wall is curved outward in a manner chosen by the designer to expand the flow. The characteristic net is constructed stepwise in this region bounded by the wall on one side and the centerline on the other. The wall is continued to be bent outward and the stepwise calculation procedure is continued until the desired Mach Number has been reached along the axis. The number of calculations that must be performed is large since the fineness of the net determines the accuracy of the solution. The Mach line from the point on the axis where the final Mach Number has been reached is straight since the exit flow is uniform. The characteristic net continues to be constructed using reference information from the final Mach line and the already constructed grid. Once the characteristics are completed, the streamlines may be constructed by interpolation since the velocities are now known at every net point. The wall may then be completed downstream as the outermost streamline. The diameter at the exit of the nozzle must agree with the isentropically calculated value and serves as a check on the construction accuracy of the grid. The literature describes many specific older graphical and newer numerical methods for designing axially symmetric nozzles all of which generally involve the computation of characteristic grids and determine the wall profile as a large number of discrete points.

K. Foelsch, in *The Analytical Design of an Axially Symmetric Laval Nozzle for a Parallel and Uniform Jet,* Journal Aeronautical Science, Vol. 16, March 1949, pp. 161–166, 185, however, describes an elegant approximation for the configuration of the wall of an axisymmetric nozzle which produces uniform exit flow. Foelsch determines the straightening section wall shape using a perturbation approach and the conservation of mass flow through discrete surfaces in the nozzle. Although this saves significant computation of flow nets as indicated above, Foelsch still determines the wall profile as a large series of discrete points. It is, thus clear that the design of the interior shape of a nozzle to produce a desired, optimal, supersonic gas flow involves detailed and laborious calculation.

Supersonic gas jet excavation nozzles used for excavation purposes are different than rocket nozzles in a number of important ways. Supersonic gas jet nozzles for earth excavation operate at significantly lower pressures and temperatures than rocket nozzles. For example, a rocket's chamber pressure may reach 1,000 to 3,000 psig and the exhaust gas temperature may be 1,800° to 7,700° F., while typical gas jet excavation nozzles operate at around 100 to 200 psig and at 80° to 140° F. The velocity of the exhaust gas exiting from a chemical rocket's nozzle may be from 6,000 to 14,000 ft/sec; while for an excavation nozzle typical values are from 1,700 to 2,000 ft/sec. Due to the higher operating parameters and lower ambient conditions, the exit to throat area ratio for rocket nozzles is large, reaching almost 80 for the main space shuttle engines for example. For gas jet excavation nozzles, this area ratio is typically below three. The specific nozzle profile for a typical rocket nozzle is, thus, significantly different in shape than for a gas jet excavation nozzle.

Although some simplified procedures for the design of rocket nozzles have been described in the literature, these alone are not sufficient for the design of the gas jet excavation nozzles because of the significant differences in the character of the profile. G. V. R. Rao, for example, in the article "Approximation of Optimum Thrust Nozzle Contour", ARS Journal, Vol. 30., No. 6, June 1960, p. 561, has described a parabolic nozzle contour that well approximates the Method of Characteristics wall of the optimum thrust rocket nozzle. Sinyarev and Doborovolskii, *Zhidkostne Raketne Drigateli*, Moscow, 1957 (in Russian) describe without any specific details a shaped nozzle employed in Russian medium and high power rocket engines with a high degree of expansion that uses a combination of conical and spherical radius surfaces for its divergent portion.

While some rocket nozzles are large enough inside for a man to stand upright, the nozzles for earth excavation are practically of a very small size. Typical lengths are less than 1 inch; typical diameters are fractions of an inch. These nozzles, being axisymmetric, are typically machined from solid rod stock by a combination of drilling and boring the profile. The profile must be accurate to a high tolerance and have a fine surface finish to avoid introducing losses and shock wave reflections into the flow.

For the design of the profile for a supersonic nozzle, an additional factor must be considered. Although the gas in the majority of the cross section of the nozzle may be moving at a high velocity, adjacent to the wall the velocity is zero. This transition typically takes place in a turbulent flow in a very narrow region termed the "boundary layer". Although the boundary layer may be thin, especially for nozzles of small size, it is not negligible. In order for the nozzle to pass the desired amount of flow, the wall diameter at any given axial section must be increased by a displacement layer thickness to account for the boundary layer. The longer the divergent portion of the nozzle, the more the boundary layer can grow. An earth excavation nozzle with a very small divergence angle is subject to the greatest boundary layer growth, and hence, greatest deviation in flow conditions. Methods for calculating the growth of the boundary layer are described in the prior art literature as, for example, by R. E. Wilson, *Turbulent Boundary Layer Growth with Favorable Static Pressure Gradient at Supersonic Speeds*, Proceedings of the Second Midwestern Conference on Fluid Mechanics, The Ohio State University, 1952.

Even with today's numerically controlled machine tools, the translation of an engineering design into hardware is a complicated process. Complete integration of computer integrated engineering, drafting, and manufacturing is not a reality for many manufacturers. Information must be transmitted and translated at each stage of the process. This is especially accurate in the instance of the gas jet excavation nozzles. The specification of the nozzle profile from engineering as a set of discrete points, for example by the Method of Characteristics or the even the simplified method of Foelsch, requires an additional stage of fitting a spline curve through these points and generating of a much finer set of specific arc and line segments that can be programmed directly into the machine tool. The machine tool set of data bears little obvious relation to the desired profile from which it was generated. This introduces an area where inadvertent errors may easily be made.

Therefore, it is an object of the present invention to simplify and improve this process since the engineering information for the profile can be directly and readily programmed as a simple set of a relatively few arc and line segments into the machine tool.

It is another object of the present invention to provide a simple, but correctly contoured supersonic nozzle to produce a uniform supersonic gas flow.

It is another object of the present invention to provide a method that simplifies the design and production of a small supersonic nozzle to produce a uniform supersonic gas flow.

SUMMARY OF THE INVENTION

The present invention defines an interior contour profile which is used in the manufacture of a supersonic gas jet excavation nozzle based upon a plurality of interconnected arc and line segments. The contour profile defined using these arc and line segments is determined by gas dynamic equations. It is believed that the defined contour profile of the invention is significantly less complicated to calculate than previously described analytical or numerical methods. A nozzle produced utilizing this method provides a supersonic gas flow having a uniform flow at its exit. The method allows for compensation for boundary layer effects when designing the nozzle. Finally, the present invention discloses a nozzle that can be readily manufactured because the method disclosed simplifies and improves the production of the nozzle. This method allows the engineering information for the contour profile to be directly and readily programmed as a simple set of arc and line segments into a machine tool.

More specifically, the present invention is a method for manufacturing an axisymmetric nozzle that includes the steps of defining a profile of the nozzle and manufacturing a nozzle having the profile. The nozzle includes a converging portion and a diverging portion. The converging portion includes a first end and a second end, the second end having a slope of zero. The diverging portion includes three segments. The first segment is an arc of a circle having a third end and a fourth end. The third end corresponds with the second end and has a slope of zero. The second segment is a straight line having a fifth end and a sixth end. The second segment includes a slope equal to the tangent of the fourth end. The fourth end corresponds to the fifth end. The third segment is an arc of a circle having a seventh end and an eighth end, where the sixth end corresponds to the seventh end and the slope of the second segment is equal to the tangent of the third segment at the seventh end. The first end of the profile corresponds to an inlet of the nozzle and the second end and third end correspond to a throat of the nozzle and the eighth end corresponds to an exit of the nozzle.

Another aspect of the present invention is an axisymmetric nozzle that includes an inlet, an exit, a converging portion and a diverging portion. The converging portion meets the diverging portion and a throat of the nozzle. The converging portion and the diverging portion are defined by a profile rotated about a central longitudinal axis. The profile includes a continuously converging segment having a first end and a second end. The first end corresponds to the inlet and the second end terminates at the throat and has a slope of zero. The diverging section is defined by three segments. The first segment is an arc of a circle having a third end and a fourth end. The third end corresponds with the second end and has a slope of zero. The second segment is a straight line having a fifth end and a sixth end. The second segment has a slope equal to the tangent of the first segment at the fourth end. The fourth end corresponds to the fifth end. The third segment is an arc of a circle that has a seventh end and an eighth end, where the sixth end corresponds to the seventh end and the slope of the second segment is equal to that of the tangent of the third segment at the seventh end. The eighth end corresponds to the exit.

Another aspect of the invention is a device for ejecting a stream of compressed gas. The device includes a compressor for supplying a compressible gas and a nozzle fluidly coupled to the compressor where the nozzle is of the type that has been previously described.

Another aspect of the invention is an axisymmetric nozzle that includes an inlet, an outlet, a converging portion and a diverging portion. The inlet is defined in the converging portion. The outlet is defined in the diverging portion. The converging portion is connected to the diverging portion at a throat. The converging portion and the diverging portion are defined by a continuous profile defined by arcs of circles and at least one line segment.

DESCRIPTION OF THE PREFERRED EMBODIMENT

Figure 1:
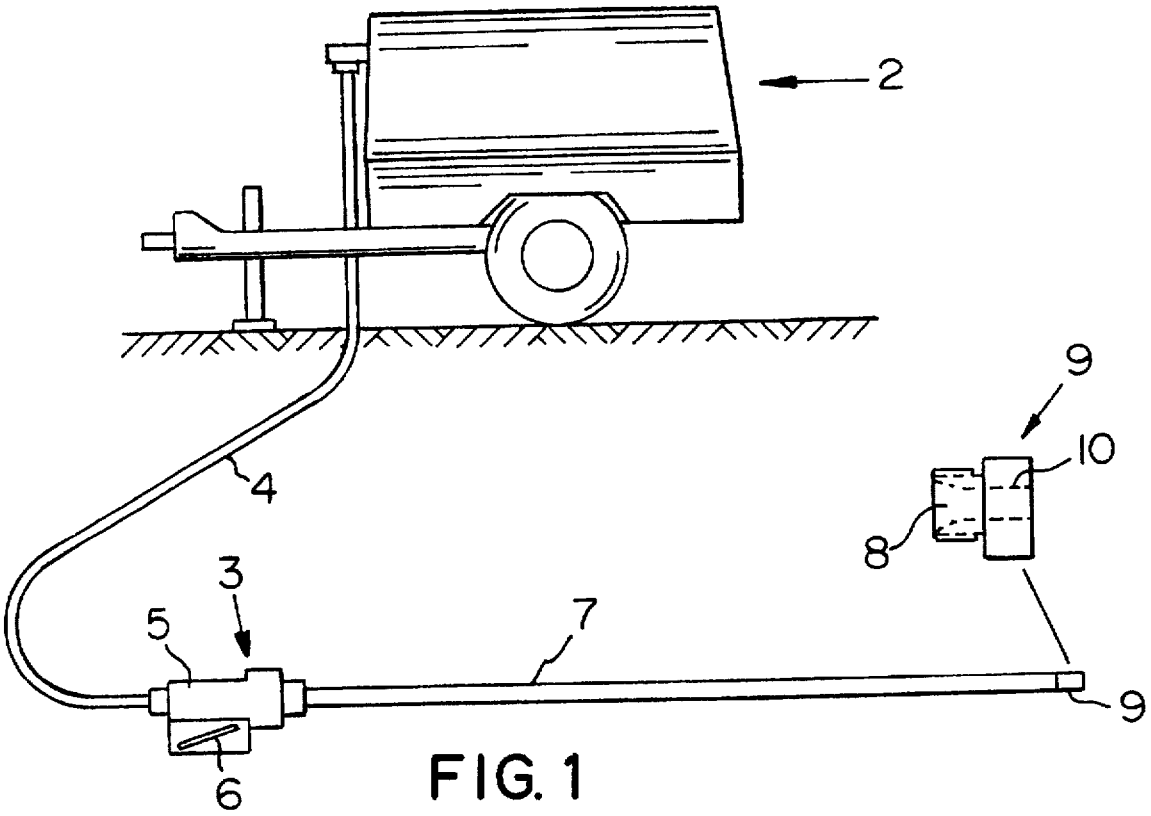
FIG. 1 is an example of an earth excavation tool having a nozzle made in accordance with the present invention.

FIG. 1 shows an example of a tool configuration which can be used for earth excavating. This configuration includes an air compressor 2 and a control 3 connected by a flexible hose 4. The control 3 includes a handle 5, a trigger 6 and an internal valve (not shown). A wand 7 extends from the control 3 and includes a housing 9 extending from the opposite end of the control 3. The housing 9 contains a nozzle 8 having a contour or profile 10. Nozzle 8 and housing 9 may be physically the same element. In this arrangement, the air compressor 2 is fluidly coupled to the nozzle 8. Air is supplied to the closed valve in the control 3 from the air compressor 2 via the flexible hose 4. The trigger 6 is used to open the internal valve and allow the air to flow through the nozzle 8 via the wand 7. The air exits the nozzle 8 as a uniform flow at the desired speed that it was designed for using the method of the present invention.

Figure 2:
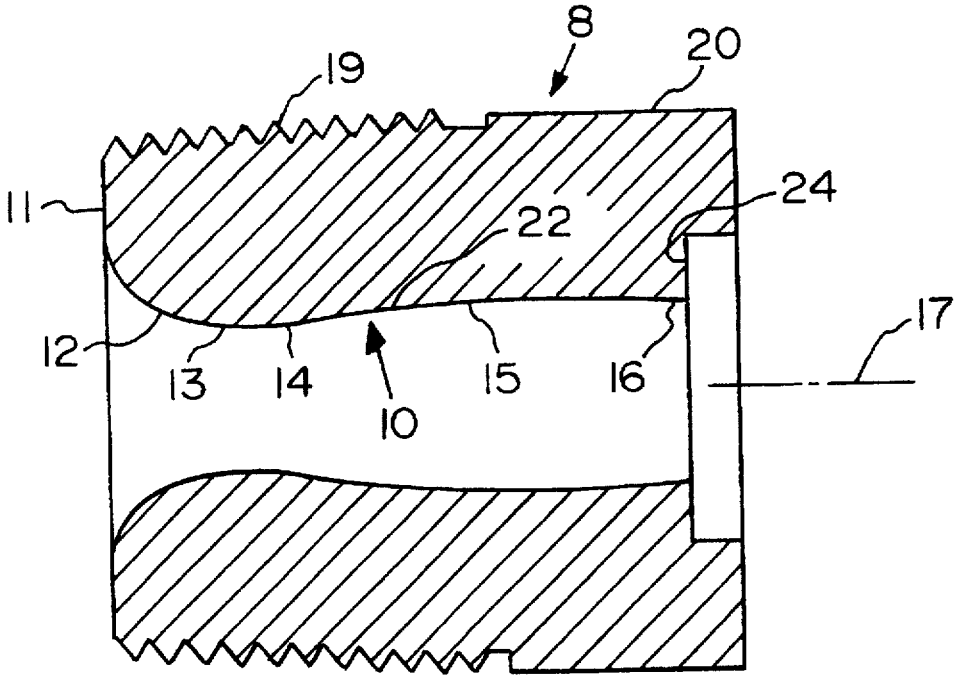
FIG. 2 is a cross-sectional view of a simple contoured supersonic nozzle made in accordance with the present invention.

FIG. 2 shows a cross-sectional view of the nozzle 8. The flow passage for the nozzle 8 is defined by rotating a specific contour or profile 10 completely about the longitudinal axis 17 of the nozzle 8. In this manner, the passage of the nozzle 8 is axisymmetric and its axis 17 is a straight line. The entrance end 11 is supplied with a compressed gas, which in the case of an earth excavating nozzle is preferably air. The nozzle 8 is divided into a first section or converging portion 12 having a surface converging toward a throat 13. The throat 13 connects to both the converging portion 12 and a diverging portion of the nozzle 8 so that the converging portion meets the diverging portion at the throat 13. The converging first section 12 accelerates the gas to Mach Number 1 close to the throat 13.

Preferably, the converging section continually converges. The contour 10 of the converging first section 12 may be any one of a number of possibilities provided that it is gradually narrowing and smoothly varying without discontinuities or abrupt changes in slope and that its tangent becomes parallel to the axis of the nozzle 8 at the throat 13. Possibilities include a single circular arc, a line segment tangent to a circular arc which extends to the throat, a continuous higher order curve such as a parabola, and so on. The throat 13 connects to a first diverging section 14 which expands the gas to the desired exit Mach Number M3. A second diverging section 15 functions to straighten the flow to be essentially parallel to the axis 17 of the nozzle 8. The contour 10 for the second diverging section 15 consists of a single circular arc. The use of this singular circular arc of a specifically chosen radius is different and unique from any of the prior art. The nozzle 8 terminates at its exit 16, the gas being accelerated to the proper Mach Number and aligned to flow in a uniform and essentially parallel manner from the nozzle 8.

It should be understood that the nozzle 8 may be disposed and retained within or by a separate housing (not shown), and it may be this housing which is connected to the source of compressed air. Such housings are generally known, and it is not intended that the invention be limited to any particular means of connection. The nozzle 8 is preferably formed of a material suitable to withstand the pressure and to resist wear, such materials typically being aluminum, brass, stainless steel, or suitable machinable plastic. Non-sparkling materials, such as beryllium copper or certain aluminum bronzes, may be advantageous as a nozzle material where excavation needs to be done in a hazardous, gaseous environment. It will be seen by those skilled in the art that multiple nozzles may be placed in a single housing or multiple passages disposed in a single piece of material. The outside profile of the nozzle may be any shape convenient to connect the nozzle to the housing or to the source of compressed air. Shown in FIG. 2 is an external male pipe thread 19 and an external hex 20 for convenient screw attachment to a standard pipe coupling. It is understood that the nozzle 8 conforms to conventional engineering practice in that the wall thickness around the profile 10 is strong enough to withstand the forces due to the internal pressure with an appropriate factor of safety.

Figure 3:
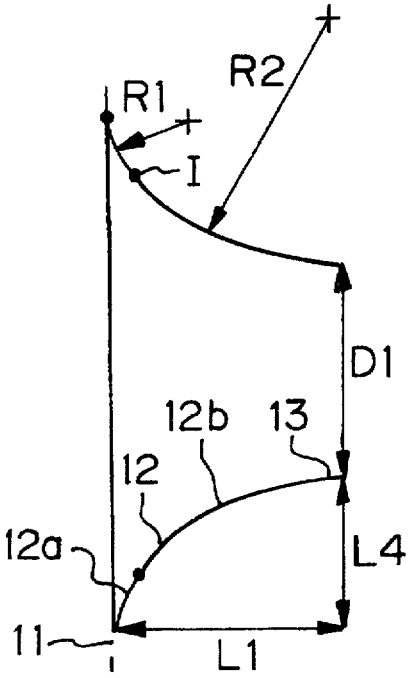
FIGS. 3 and 4 are more detailed cross-sectional views of one specific set of relationships between the diameters, lengths, radii, and angles of a simple contoured supersonic nozzle made in accordance with the present invention.
Figure 4:
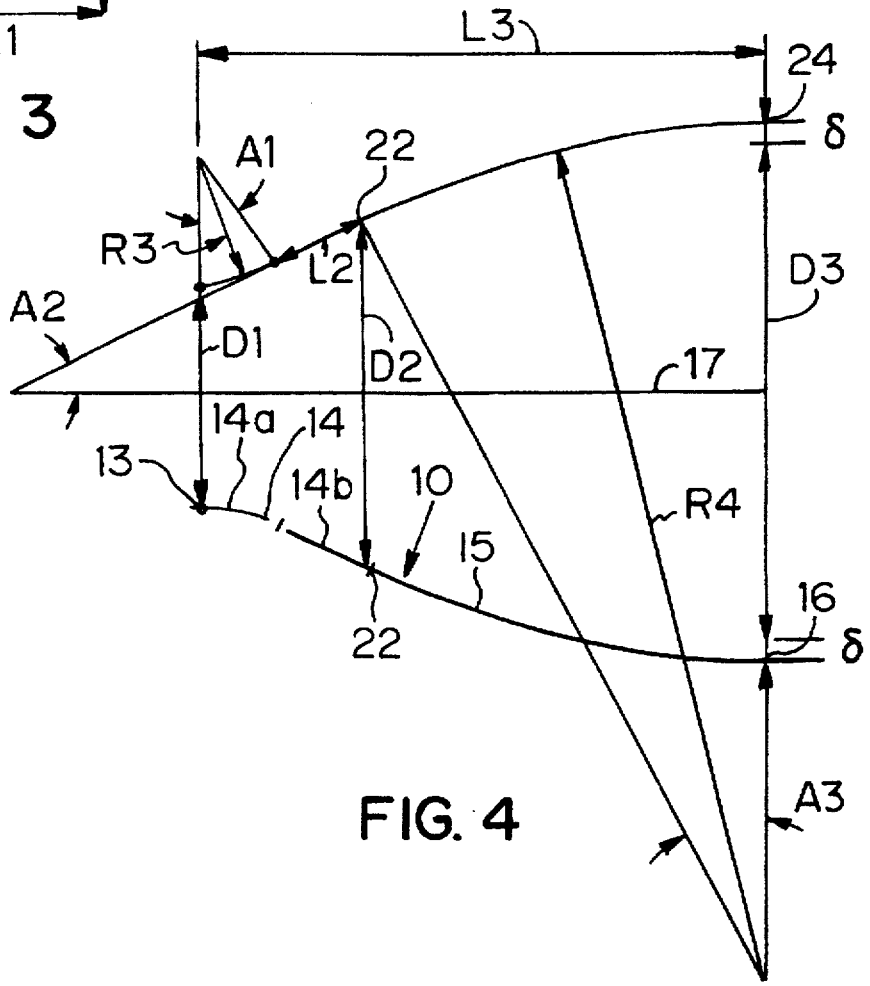

FIGS. 3 and 4 define in more detail the diameters, lengths, radii, and angles of a simple contoured supersonic nozzle according to the invention. Using the isentropic gas relations for a given value of pressure ratio, P0/P3, of the inlet to the exit absolute pressures of the compressed gas flowing through the nozzle, it is directly possible to calculate the exit Mach Number, M3 as:

$$M3=\sqrt{\frac{2}{\gamma-1}\left[\left(\frac{P0}{P3}\right)^{\frac{\gamma-1}{\gamma}}-1\right]} \qquad \text{Eq. 1}$$

where:

M3=Exit Mach Number

P0=Inlet absolute pressure

P3=Exit absolute pressure $\gamma$=Isentropic gas exponent

The throat and exit diameters, D1 and D3, respectively, may also be calculated according to the one dimensional theory such that the volume flow rate of the gas, Q, defined at standard conditions is as desired. The standard equations to determine these quantities can be defined for reference in the following form:

$$D1=\left(\frac{2}{\gamma+1}\right)^{\left(\frac{-(\gamma+1)}{4(\gamma-1)}\right)}\sqrt{\frac{4\rho Q}{\pi P0}\sqrt{\frac{R(T0)}{\gamma}}} \qquad \text{Eq. 2}$$

-continued $$D3=\frac{D1}{\sqrt{M3}}\left[\frac{1+\frac{\gamma-1}{2}(M3^2)}{\frac{\gamma+1}{2}}\right]^{\frac{\gamma+1}{4(\gamma-1)}} \quad \text{Eq. 3}$$

where:

ρ=Density of gas at standard conditions

Q=Volume flow rate of gas at standard conditions

R=Gas constant

T0=Inlet absolute temperature of the gas

Shown in FIG. 3, the first convergent section 12 includes two circular arcs 12*a* and 12*b* having radii R1 and R2, respectively. These two arcs are tangent to each other where they join at an intersecting point I so that they form a continuously converging section without any discontinuity which will exist where two straight lines are used to define the converging sections or where the points of intersection of segments 12*a* and 12*b* are not tangent at the point where they join. The entrance end 11 of the nozzle 8 is perpendicular to the axis 17 in this case. The tangent to arc 12*b* at the throat 13 is parallel to the nozzle axis 17. The values for the two radii, R1 and R2 in this case, are chosen such that the combined arcs closely approximate an elliptical entrance in accordance with the accepted practice for a low beta ASME flow nozzle. The length L1 of the major axis of the elliptical entrance is equal to D1, and the length L4 of the minor axis is equal to ⅔ D1. Mathematically, R1 and R2 can be determined as:

$$R1=\frac{D1}{3} \quad \text{Eq. 4}$$

$$R2=\frac{7(D1)}{6} \quad \text{Eq. 5}$$

Shown in FIG. 4, the first divergent section 14 includes two parts which combine to create a conical flow. The first part consists of a circular arc 14*a* of radius R3 whose tangent at the throat 13 is parallel to the nozzle axis 17. Arc 14*a* subtends an angle A1. The second part 14*b* is a line segment directed at an angle A2 to the axis 17 of the nozzle. The length of the line segment 14*b* is L2. The arc 14*a* and line segment 14*b* are tangent where they connect.

Figure 5:
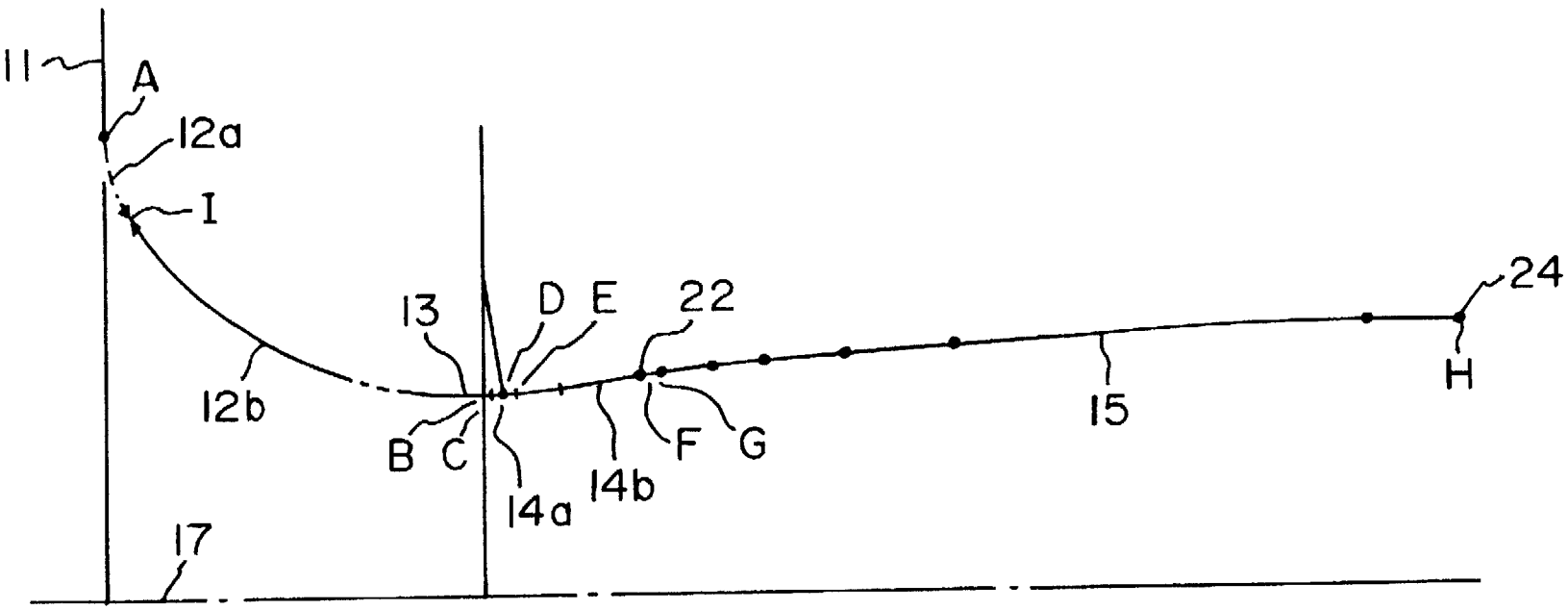
FIG. 5 shows an example of a simple profile determined according to the present invention fitting through a numerically determined set of discrete points as, for example, by the method of Foelsch.

The second diverging section 15 is devised by a single, circular arc of radius R4. The radius R4 is chosen to greatly simplify design and manufacture, but also to be an excellent approximation to the complicated set of discrete points generated by other previously mentioned graphical or numerical methods. The arc of the second diverging section 15 subtends an angle A3. At its first end point 22, the arc of the second diverging section 15 connects with line segment 14*b*. The tangent to the arc of the second diverging section 15 at this point is collinear with the line segment 14*b*. A second end point 24 of the arc of the second diverging section 15 coincides with the exit 16 of the nozzle 8. The tangent to the arc of the second diverging section 15 is parallel to the axis 17 at the second end point 24. Hence, the diverging portion is made up of three segments 14*a*, 14*b* and 15, where segments 14*a* and 15 are arcs of circles and segment 14*b* is a straight line. The converging section has two ends A and B and segments 14*a*, 14*b* and 15 each have two ends C, D, E, F, G and H, respectively, and as shown in FIG. 5. Ends B and C, D and E, and F and G correspond to each other, respectively. The slope at ends B and C is zero. The slope of segment 14*b* is equal to the tangent at end D of segment 14*a*. Likewise, the slope of the segment 14*b* is equal to the tangent at end G of segment 15. Preferably, the slope of segment 15 at end H is zero. In this arrangement, an axisymmetric nozzle is defined where the nozzle inlet 11 is defined in the converging portion and the nozzle outlet or exit is defined in the nozzle diverging portion where the diverging position intersects the converging portion at the throat and the converging portion and the diverging portion are defined by a continuous profile defined by arcs of circles and at least one line segment.

The shortest nozzle, which hence needs the least amount of material for manufacture, is determined by choosing A2 to be equal to ¼Φ (M3) where Φ(M) is defined by the Prandtl-Meyer relationship:

$$\Phi(M)=\left[\sqrt{\frac{\gamma+1}{\gamma-1}}\,\mathrm{atan}\left[\sqrt{\frac{\gamma-1}{\gamma+1}(M^2-1)}\right]-\mathrm{atan}\sqrt{M^2-1}\right] \quad \text{Eq. 6}$$

The Mach Number M3 is the exit Mach Number.

The value of the Mach Number M2 at point 22 is found by solving the Prandtl-Meyer function in an iterative manner as:

$$\Phi(M2)=2(A2) \quad \text{Eq. 7}$$

The diameter D2 at the first end point 22 of the second diverging section 15 is determined using τ(M), the square root of the isentropic area ratio relationship:

$$\tau(M)=\sqrt{\frac{1}{M}\left[\left(\frac{2}{\gamma+1}\right)+\left(\frac{\gamma-1}{\gamma+1}\right)(M^2)\right]^{\frac{\gamma+1}{2(\gamma-1)}}} \quad \text{Eq. 8}$$

$$D2=(D1)\tau(M2) \quad \text{Eq. 9}$$

where D2 is the nozzle diameter at 22, which is at ends F and G.

The throat radius R3 is computed after Foelsch by:

$$R3=\frac{D3\left[\tau(M2)\cos\left(\frac{A2}{2}\right)-1\right]}{(4)\tau(M3)\sin\left(\frac{A2}{2}\right)\left[\sin\left(\frac{A2}{2}\right)+\cos\left(\frac{A2}{2}\right)\right]} \quad \text{Eq. 10}$$

In the preferred embodiment according to the present invention, the radius R4 of the second diverging portion 15 is given by:

$$R4=\frac{D3\left(1-\frac{\tau(M2)}{\tau(M3)}\cos(A2)\right)}{(4)\sin(A2)\sin\left(\frac{A2}{2}\right)}+D3\left(\frac{\sqrt{M3^2-1}}{(2)\sin(A2)}\right) \quad \text{Eq. 11}$$

As shown in FIG. 4, the second diverging radius 15 intersects the end plane of the nozzle at 24 at a diameter sightly greater than the isentropically calculated exit diameter value of D3. This amount δ provides a reasonable approximation for the boundary layer displacement thickness δ* mentioned earlier, eliminating any additional and complicated calculation.

The length of the supersonic portion of the nozzle after Foelsch is given by:

$$L3 = \frac{D3}{(4)\sin\left(\frac{A2}{2}\right)} + \frac{D3}{2}\sqrt{M3^2 - 1} - \frac{D1}{(2)\tan(A2)} + (R3)\tan\left(\frac{A2}{2}\right) \quad \text{Eq. 12}$$

In the preferred embodiment, A1 and A3 are chosen to be the same as A2. L2 is set equal to R3.

As a practical example, consider a supersonic gas jet excavation nozzle designed to have a flow rate Q of 50 scfm of air to atmosphere at sea level from a compressor providing an inlet pressure of 85 psig and an inlet temperature of 140° F. Initially, the operating nozzle inlet pressure, the nozzle outlet pressure, the nozzle operating temperature and the gas flow rate are identified. With this information and knowing that supersonic flow is desired, which means that the Mach Number equals one at the throat, then the exit Mach Number and the ratio of the throat diameter and the nozzle exit diameter can be calculated using equations 1–3. The throat diameter and exit diameter can then be calculated. This information is then supplied to the above-identified equations to determine the actual geometries of the nozzle. The following table gives the various radii, angles, and lengths for the simplified nozzle profile made in accordance with the present invention.

TABLE I

| Nozzle design parameters | Value |
|---|---|
| Inlet pressure, P0 (psia) | 99.7 |
| Inlet temperature, T0 (°R.) | 600 |
| Exit pressure, P3 (psia) | 14.7 |
| Flow rate, Q (scfm) | 50 |
| Gas density, ρ (lbm / in$^3$) | 0.0763 |
| Gas constant, R (f-lbf / lbm °R.) | 53.34 |
| Isentropic exponent, γ (–) | 1.4 |
| Throat diameter, D1 (in) | 0.193 |
| Intermediate diameter, D2 (in) | 0.210 |
| Exit diameter, D3 (in) | 0.242 |
| Intermediate Mach No., M2 (–) | 1.50 |
| Exit Mach Number, M3 (–) | 1.91 |
| First inlet radius, R1 (in) | 0.064 |
| Second inlet radius, R2 (in) | 0.226 |
| Throat radius, R3 (in) | 0.074 |
| Straightening radius, R4 (in) | 3.44 |
| Half apex angle, A2 (deg) | 6.0 |
| Inlet length, L1 (in) | 0.193 |
| Supersonic length, L3 (in) | 0.438 |
| Boundary layer adjustment, δ (in) | 0.002 |

From the preceding table, it can been seen that the boundary layer adjustment δ increases the exit area by approximately 3% and the radii $R_2$ and $R_3$ are different. FIG. 5 shows an example nozzle profile drawn to scale illustrating how well the single arc R4 for the supersonic portion of this profile fits the discrete series of points calculated according to the method of Foelsch.

By adjusting the arc radius R4 and the center from which this arc is constructed, it is possible that other formulas for single arc approximations may be found to substitute for the complicated series of graphically or numerically determined points from either the Method of Characteristics or from Foelsch's method. The mathematical method outlined herein with the given equations is preferred. It is to be considered that all single arc approximations of the second diverging section 15 to a discrete set of points calculated by a more detailed method fall within the spirit and scope of this invention. With the above information about the arcs and lines describing the nozzle profile, the nozzle can be formed where end A corresponds to the inlet of the nozzle 8, the second and third ends B and C correspond to the throat 13 of the nozzle 8, and the end H corresponds to the exit 16 of the nozzle 11. Further, the nozzle 8 represented by the above criteria of radii, slopes and line lengths, and angular lengths can then be machined using a CNC (computer numerical controlled) machine. Preferably, the nozzle exit area to throat area ratio is three or less.

In another arrangement, if it is desired by the designer that the compensation δ at the exit end of the nozzle be exactly the boundary layer displacement amount δ*, such as calculated by an independent method as, for example, outlined by Wilson, the design method may be altered slightly still in keeping with the described profile of the subject invention. To set δ equal to δ* at the end of the nozzle, it is necessary to let A2 vary slightly from previous value. R3, R4 and L3 can be determined from the geometry of the diverging section of the nozzle to satisfy the following three equations:

$$R3 = \frac{D2 - D1}{2(1 - \cos(A2) + \sin(A2))} \quad \text{Eq. 13}$$

$$R4 = \frac{D3 + (2)\delta^* - D2}{2(1 - \cos(A2))} \quad \text{Eq. 14}$$

$$L3 = \frac{(D2 - D1)(\sin(A2) + \cos(A2))}{2(1 - \cos(A2) + \sin(A2))} + \frac{(D3 + (2)\delta^* - D2)\sin(A2)}{2(1 - \cos(A2))} \quad \text{Eq. 15}$$

Using the Prandtl-Meyer function (Eq. 6), the square root of the area ratio function (Eq. 8) and equations 7, 9 and 12–15, it is possible to simultaneously solve for A2, M2, D2, R3, R4 and L3. In practice, this results in a slightly longer nozzle. For the case listed in the table, A2 is reduced by about 10% and the supersonic length L3 is increased by about 0.05 inches.

While the preferred embodiment of the invention has been described in detail herein, it will be appreciated by those skilled in the art that various modifications and alternatives to the embodiment could be developed in light of the overall teachings of the disclosure. Accordingly, the particular arrangements are illustrative only and are not limiting as to the scope of the invention which is to be given the full breadth of the appended claims and any and all equivalents thereof.

I claim:

1. A method for manufacturing an axisymmetric nozzle comprising the steps of:

defining a profile of a nozzle comprising:

a converging portion having a first end and a second end, said second end having a slope of zero; and a diverging portion having three segments, said first segment being an arc of a circle having a third end and a fourth end, said third end corresponding with said second end and having a slope of zero, said second segment being a straight line having a fifth end and a sixth end, said second segment having a slope equal to the tangent at said fourth end, wherein said fourth end corresponds to said fifth end, and said third segment being an arc of a circle having a seventh end and an eighth end, where said sixth end corresponds to said seventh end and the slope of said second segment is equal to the tangent of said third segment at said seventh end and wherein a first angle is subtended by said first segment, said second segment has a slope equal to a second angle and a third angle is subtended by said third segment, and the first angle, the second angle and the third angle are equal to each other; and manufacturing a nozzle having said profile, wherein said first end of the profile corresponds to an inlet of the nozzle, said second end and said third end correspond to a throat of the nozzle and said eighth end corresponds to an exit of the nozzle.

2. A method as claimed in claim 1, wherein said nozzle is machined.

3. A method as claimed in claim 2, wherein said nozzle is machined by a CNC machine.

4. A method as claimed in claim 1, wherein said converging section continuously converges from said first end to said second end without any discontinuities.

5. A method as claimed in claim 4, wherein said converging section is defined by two circular arcs, each being tangent to the other at an intersection point.

6. A method as claimed in claim 1, further comprising the steps of:

a) identifying an inlet pressure value, an exit pressure value and an operating temperature of the nozzle;

b) identifying a gas flowing through the nozzle;

c) calculating an exit Mach Number for the nozzle;

d) identifying a gas flow rate passing through the nozzle;

e) calculating the nozzle throat diameter; and f) calculating a nozzle exit diameter.

7. A method for manufacturing a nozzle as claimed in claim 1, wherein the exit of the nozzle includes an exit diameter that takes into account a boundary layer.

8. A method for manufacturing a nozzle as claimed in claim 1, wherein a nozzle exit area to throat area ratio is three or less.

9. A method for manufacturing an axisymmetric nozzle as claimed in claim 1 further comprising the step of determining a nozzle length of the diverging portion and dimensions of said first segment, said second segment and said third segment by the following set of equations:

$$M3=\sqrt{\frac{2}{\gamma-1}\left[\left(\frac{P0}{P3}\right)^{\frac{\gamma-1}{\gamma}}-1\right]}$$

where:

M3=Exit Mach Number;

P0=Inlet absolute pressure;

P3=Exit absolute pressure;

γ=Isentropic gas exponent;

$$D1=\left(\frac{2}{\gamma+1}\right)^{\left(\frac{-(\gamma+1)}{4(\gamma-1)}\right)}\sqrt{\frac{4\rho Q}{\pi P0}\sqrt{\frac{R(T0)}{\gamma}}}$$

$$D3=\frac{D1}{\sqrt{M3}}\left[\frac{1+\frac{\gamma-1}{2}(M3^2)}{\frac{\gamma+1}{2}}\right]^{\frac{\gamma+1}{4(\gamma-1)}}$$

where:

ρ=Density of gas at standard conditions;

Q=Volume flow rate of gas at standard conditions;

R=Gas constant;

D1=The nozzle throat diameter;

D3=The nozzle exit diameter;

T0=Inlet absolute temperature of the gas;

$$L3=\frac{D3}{(4)\sin\left(\frac{A2}{2}\right)}+\frac{D3}{2}\left(\sqrt{M3^2-1}\right)-\frac{D1}{(2)\tan(A2)}+(R3)\tan\left(\frac{A2}{2}\right)$$

where:

L3=The length of the diverging portion of the nozzle;

A2=The angular slope of the second segment and the angle that subtends both the first segment and the third segment;

$$R3=\frac{D3\left[\tau(M2)\cos\left(\frac{A2}{2}\right)-1\right]}{(4)\tau(M3)\sin\left(\frac{A2}{2}\right)\left[\sin\left(\frac{A2}{2}\right)+\cos\left(\frac{A2}{2}\right)\right]}$$

where:

R3=The radius of the first segment;

D2=The nozzle diameter at the end of the second segment and beginning of the third segment;

$$R4=\frac{D3\left(1-\frac{\tau(M2)}{\tau(M3)}\cos(A2)\right)}{(4)\sin(A2)\sin\left(\frac{A2}{2}\right)}+D3\left(\frac{\sqrt{M3^2-1}}{(2)\sin(A2)}\right)$$

where:

R4=The radius of the third segment;

$$\tau(M)=\sqrt{\frac{1}{M}\left[\left(\frac{2}{\gamma+1}\right)+\left(\frac{\gamma-1}{\gamma+1}\right)(M^2)\right]^{\frac{\gamma+1}{2(\gamma-1)}}}$$

where:

τ(M)=The square root of the isentropic area ratio relationship;

D2=D1 τ(M2)

where:

τ(M2)=The isentropic area relationship at the beginning of the third segment;

$$A2=\frac{\Phi(M3)}{4}=\frac{\Phi(M2)}{2}$$

where:

$$\Phi(M)=\left[\sqrt{\frac{\gamma+1}{\gamma-1}}\,\mathrm{atan}\left[\sqrt{\frac{\gamma-1}{\gamma+1}(M^2-1)}\right]-\mathrm{atan}\sqrt{M^2-1}\right].$$

10. A method for manufacturing an axisymmetric nozzle as set forth in claim 1, wherein said eighth end of said third segment has a slope of zero.

11. An axisymmetric nozzle comprising:

an inlet;

an exit;

a converging portion; and a diverging portion, wherein said converging portion meets said diverging portion at a throat, said converging portion and said diverging portion defined by a profile rotated about a central longitudinal axis, said profile comprising:

a continuously converging segment having a first end and a second end, said first end corresponding to said inlet and said second end terminating at said throat and having a slope of zero; and a diverging section defined by three segments, said first segment being an arc of a circle having a third end an a fourth end, said third end corresponding with said second end and has a slope of zero, said second segment being a straight line having a fifth end and a sixth end, said second segment having a slope equal to the tangent of said first segment at said fourth end, said fourth end corresponds to said fifth end, and said third segment being an arc of a circle having a seventh end and an eighth end, where said sixth end corresponds to said seventh end and the slope of said second segment is equal to that of the tangent of said third segment at said seventh end and said eighth end corresponding to said exit and wherein a first angle is subtended by said first segment, said second segment has a slope equal to a second angle and a third angle is subtended by said third segment, and the first angle, the second angle and the third angle are equal to each other.

12. A nozzle as claimed in claim 11, wherein said nozzle is made of metal.

13. A nozzle as claimed in claim 12, wherein said converging section is defined by two segments that intersect an intersection point.

14. A nozzle as claimed in claim 13, wherein said two converging segments are defined by two circular arcs each being tangent to the other at their intersection point.

15. A nozzle as claimed in claim 12, wherein said metal is a non-sparkling metal.

16. A nozzle as claimed in claim 11, wherein a tangent of at said eighth end has a slope equal to zero.

17. A nozzle as claimed in claim 11, wherein a nozzle exit area to throat area ratio is three or less.

18. A nozzle as claimed in claim 11, wherein a nozzle length of the diverging portion and said first segment, said second segment and said third segment dimensions are determined by the following set of equations:

$$M3=\sqrt{\frac{2}{\gamma-1}\left[\left(\frac{P0}{P3}\right)^{\frac{\gamma-1}{\gamma}}-1\right]}$$

where:

M3=Exit Mach Number;

P0=Inlet absolute pressure;

P3=Exit absolute pressure;

γ=Isentropic gas exponent;

$$D1=\left(\frac{2}{\gamma+1}\right)^{\left(\frac{-(\gamma+1)}{4(\gamma-1)}\right)}\sqrt{\frac{4\rho Q}{\pi P0}}\sqrt{\frac{R(T0)}{\gamma}}$$

$$D3=\frac{D1}{\sqrt{M3}}\left[\frac{1+\frac{\gamma-1}{2}(M3^2)}{\frac{\gamma+1}{2}}\right]^{\frac{\gamma+1}{4(\gamma-1)}}$$

where:

ρ=Density of gas at standard conditions;

Q=Volume flow rate of gas at standard conditions;

R=Gas constant;

D1=The nozzle throat diameter;

D3=The nozzle exit diameter;

T0=Inlet absolute temperature of the gas;

$$L3=\frac{D3}{4\sin\left(\frac{A2}{2}\right)}+\left(\frac{D3}{2}\right)\sqrt{M3^2-1}-\frac{D1}{2\tan(A2)}+(R3)\tan\left(\frac{A2}{2}\right)$$

where:

L3=The length of the diverging portion of the nozzle;

A2=The angular slope of the second segment and the angle that subtends both the first segment and the third segment;

$$R3=\frac{D3\left[\tau(M2)\cos\left(\frac{A2}{2}\right)-1\right]}{(4)\tau(M3)\sin\left(\frac{A2}{2}\right)\left[\sin\left(\frac{A2}{2}\right)+\cos\left(\frac{A2}{2}\right)\right]}$$

where:

R3=The radius of the first segment;

D2=The nozzle diameter at the end of the second segment and beginning of the third segment;

$$R4=\frac{D3\left(1-\frac{\tau(M2)}{\tau(M3)}\cos(A2)\right)}{(4)\sin(A2)\sin\left(\frac{A2}{2}\right)}+D3\left(\frac{\sqrt{M3^2-1}}{(2)\sin(A2)}\right)$$

where:

R4=The radius of the third segment;

$$\tau(M)=\sqrt{\frac{1}{M}\left[\left(\frac{2}{\gamma+1}\right)+\left(\frac{\gamma-1}{\gamma+1}\right)(M^2)\right]^{\frac{\gamma+1}{2(\gamma-1)}}}$$

where:

τ(M)=The square root of the isentropic area ratio relationship;

$$D2=D1\,\tau(M2)$$

where:

τ(M2)=The isentropic area relationship at the beginning of the third segment;

$$A2=\frac{\Phi(M3)}{4}=\frac{\Phi(M2)}{2}$$

where:

Φ(M)=The Prandtl-Meyer relationship;

$$\Phi(M)=\left[\sqrt{\frac{\gamma+1}{\gamma-1}}\,\mathrm{atan}\left[\sqrt{\frac{\gamma-1}{\gamma+1}(M^2-1)}\right]-\mathrm{atan}\sqrt{M^2-1}\right].$$

19. An axisymmetric nozzle as set forth in claim 11, wherein said eighth end of said third segment has a slope of zero.

20. A device for ejecting a stream of compressed gas comprising:

a compressor for supplying a compressible gas; and a nozzle fluidly coupled to said compressor, said nozzle comprising:

an inlet;

an exit;

a converging portion; and a diverging portion, wherein said converging portion meets said diverging portion at a throat, said converging portion and said diverging portion defined by a profile rotated about a central longitudinal axis, said profile comprising:

a continuously converging segment having a first end and a second end, said first end corresponding to said inlet and said second end terminating at said throat and having a slope of zero; and a diverging section defined by three segments, said first segment being an arc of a circle having a third end and a fourth end, said third end corresponding with said second end and has a slope of zero, said second segment being a straight line having a fifth end and a sixth end, said second segment having a slope equal to the tangent of said first segment at said fourth end, said fourth end corresponding to said fifth end, and said third segment being an arc of a circle having a seventh end and an eighth end, where said sixth end corresponds to said seventh end and the slope of said second segment is equal to that of the tangent of said third segment at said seventh end and said eighth end corresponds to said exit and wherein a first angle is subtended by said first segment, said second segment has a slope equal to a second angle and a third angle is subtended by said third segment, and the first angle, the second angle and the third angle are equal to each other.

21. A method for manufacturing an axisymmetric nozzle comprising the steps of:

defining a profile of a nozzle comprising:

a converging portion having a first end and a second end, said second end having a slope of zero; and a diverging portion having three segments, said first segment being an arc of a circle having a third end and a fourth end and having a first radius, said third end corresponding with said second end and having a slope of zero, said second segment being a straight line having a fifth end and a sixth end, said second segment having a slope equal to the tangent at said fourth end, wherein said fourth end corresponds to said fifth end, and said third segment being an arc of a circle having a seventh end and an eighth end, where the slope of said second segment is equal to the tangent of said third segment at said seventh end, wherein said converging portion has a profile other than an arc of a circle having a radius equal to the first radius of said first segment; and manufacturing a nozzle having said profile, wherein said first end of the profile corresponds to an inlet of the nozzle, said second end and said third end correspond to a throat of the nozzle and said eighth end corresponds to an exit of the nozzle.

22. An axisymmetric nozzle comprising:

an inlet;

an exit;

a converging portion; and a diverging portion, wherein said converging portion meets said diverging portion at a throat, said converging portion and said diverging portion defined by a profile rotated about a central longitudinal axis, said profile comprising:

a continuously converging segment having a first end and a second end, said first end corresponding to said inlet and said second end terminating at said throat and having a slope of zero; and a diverging section defined by three segments, said first segment being an arc of a circle having a third end and a fourth end and having a first radius, said third end corresponding with said second end and has a slope of zero, said second segment being a straight line having a fifth end and a sixth end, said second segment having a slope equal to the tangent of said first segment at said fourth end, said fourth end corresponds to said fifth end, and said third segment being an arc of a circle having a seventh end and an eighth end, where said sixth end corresponds to said seventh end and the slope of said second segment is equal to that of the tangent of said third segment at said seventh end and said eighth end corresponding to said exit, wherein said converging portion has a profile other than an arc of a circle having a radius equal to the first radius of said first segment.

* * * * *